US007681645B2

(12) United States Patent
McMillin et al.

(10) Patent No.: US 7,681,645 B2
(45) Date of Patent: Mar. 23, 2010

(54) SYSTEM AND METHOD FOR STIMULATING MULTIPLE PRODUCTION ZONES IN A WELLBORE

(75) Inventors: Bobby Frank McMillin, Katy, TX (US); Avel Z. Ortiz, Houston, TX (US); Mark Zimmerman, Cypress, TX (US)

(73) Assignee: BJ Services Company, Houston, TX (US)

( * ) Notice: Subject to any disclaimer, the term of this patent is extended or adjusted under 35 U.S.C. 154(b) by 31 days.

(21) Appl. No.: 11/713,062

(22) Filed: Mar. 1, 2007

(65) Prior Publication Data

US 2008/0210429 A1 Sep. 4, 2008

(51) Int. Cl.
*E21B 34/00* (2006.01)

(52) U.S. Cl. ..... 166/291; 166/307

(58) Field of Classification Search ..... 166/285, 166/291, 306, 307, 177.4
See application file for complete search history.

(56) References Cited

U.S. PATENT DOCUMENTS 6,006,838 A 12/1999 Whiteley et al.
6,907,936 B2 6/2005 Fehr et al.
7,267,172 B2 9/2007 Hofman
2004/0118564 A1 6/2004 Themig
2005/0178552 A1 8/2005 Fehr et al.
2006/0207763 A1 9/2006 Hofman ..... 166/281
2007/0272413 A1 * 11/2007 Rytlewski et al. ..... 166/318

OTHER PUBLICATIONS

International Search Report and Written Opinion dated Sep. 24, 2008, for corresponding PCT Application No. PCT/US2008/055464.

* cited by examiner

*Primary Examiner*—William P Neuder
(74) *Attorney, Agent, or Firm*—Zarian Midgley & Johnson PLLC

(57) ABSTRACT

A system and method for selectively stimulating a plurality of producing zones of a wellbore in oil and gas wells, the system being cemented within the wellbore. The system includes a plurality of modules connected in a string wherein the modules can be selectively actuated to stimulate producing zones adjacent the modules. Each module includes a sleeve shiftable between a closed position and a treating position where a plurality of radial passageways are exposed to the central passageway of the assembly. The system includes a wiper plug that is adapted to pass through ball seats of various sizes in the plurality of modules and an acid solution pumped into the string to break down the cement at the producing zones. The system may include at least one natural rubber wiper ball to remove residual cement from the string.

6 Claims, 4 Drawing Sheets

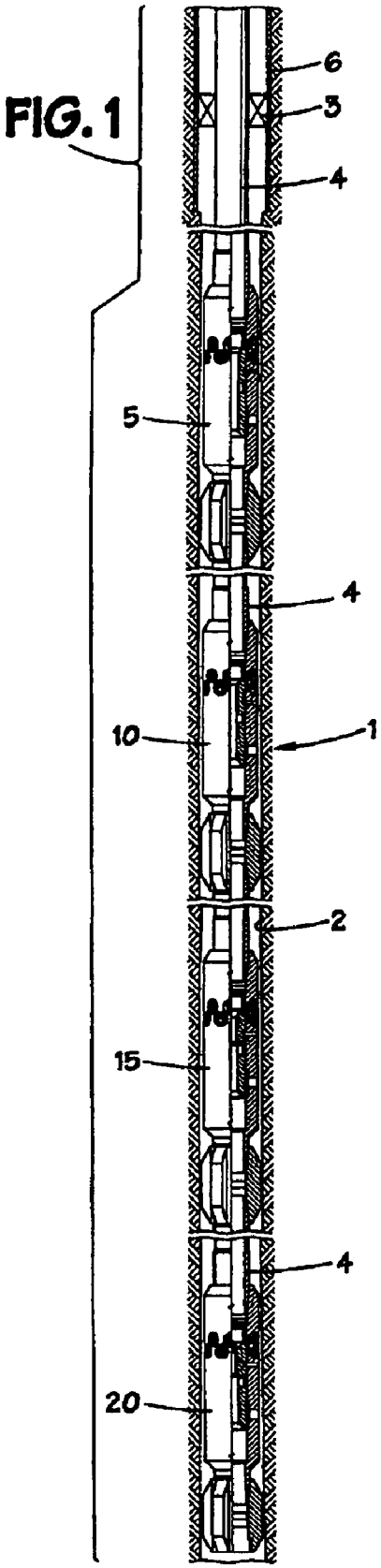
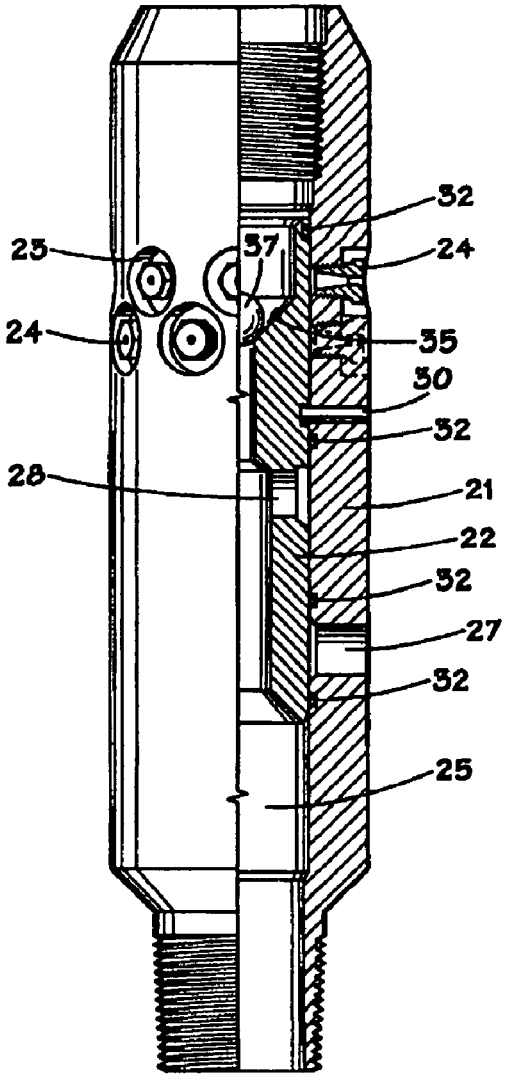
FIG. 2

SYSTEM AND METHOD FOR STIMULATING MULTIPLE PRODUCTION ZONES IN A WELLBORE

BACKGROUND OF THE INVENTION

1. Field of the Invention

The present invention generally relates an improved system and method for stimulating multiple production zones in a wellbore. U.S. Pat. No. 6,006,838 discloses a string that includes modules with sliding sleeves that may be used to stimulate multiple production zones in a wellbore in a single trip into the wellbore. The present invention discloses positioning the string disclosed in U.S. Pat. No. 6,006,838 within a desired location within a wellbore and then cementing the string in place using an acid soluble cement. Cement is pumped down the string, out the end of the string, and up and around the outside of the diameter of the string. The cement is allowed to cure cementing the string at the desired location.

A wiper plug is pumped down the string after the cement, and preferably before the displacement fluid, to wipe any residual cement from the inner diameter of the string. The wiper plug also helps to separate the acid soluble cement from acid pumped down the string after the wiper plug. At least one wiper ball may also be pumped down the string after the wiper plug. The wiper ball may be pumped down the string within a spacer fluid to help protect the wiper ball from being damaged by the acid solution. The wiper ball may help to remove any residual cement from the internal bores of the modules allowing the sliding sleeves to slide when actuated. The acid pumped within the string also prevents any residual cement from curing inside of the string.

After the cement has cured around the outside of the string, fluid is pumped down the string. The hydraulic pressure of the pumped fluid moves the sliding sleeve of the lowermost module to an open position. The acid within the string breaks down the cement around the string after the sliding sleeve of a module is opened. Hydraulic pressure may then fracture the formation adjacent the opened module. A proppant containing slurry may follow behind the acid to extend and support the fracture. Once the formation has been fractured an appropriately sized ball may be dropped down the string to land in the ball seat of the next lowermost module. The seated ball prevents flow to the first module and the pressure within the string will build until the sliding sleeve of the second module moves to the open position. The acid then breaks down the cement adjacent to the second module and hydraulic pressure may fracture the formation at this location. The process is repeated until cement adjacent each module has been broken down and each of the specified zones have been fractured.

2. Description of the Related Art

This present invention relates to an improved system and method for stimulating producing zones of an openhole wellbore in oil and gas wells. Previously disclosed was an assembly for selectively stimulating a wellbore without the use of openhole inflatable packers. This assembly is especially suited to perform a combination of matrix acidizing jobs and near wellbore erosion jobs at a number of producing zones in the wellbore in a single trip.

Prior to the disclosed assembly, operators who were interested in stimulating multiple producing zones in an openhole wellbore could stimulate the zones one zone at a time by using a workstring and an openhole inflatable packer. Such a method and assembly required the operator to set an inflatable packer (or other similar apparatus) above each zone of interest to be stimulated and then, following the stimulation job, to release the packer (or packers) and trip the packer assembly to a new location where it would be reset for the next stimulation job. This procedure would be repeated for each desired zone of interest. However, because of the tripping time and the difficulty in setting and maintaining the seal in inflatable packers in openhole wellbores, such a method was both time consuming and relatively unreliable. Furthermore, openhole inflatable packers (or other similar devices) are expensive to rent or to purchase. As a result of the relative unreliability and cost of using openhole inflatable packers, such assemblies prove to be uneconomical in marginal fields such as fields in the Permian Basin region of West Texas and Eastern New Mexico.

The previously disclosed assembly does not require an inflatable packer and is very economical to build and maintain. Thus, an operator can use the assembly for a small incremental cost over what it costs to perform an acid job and receives the benefits of not only a matrix acidizing treatment, but can also enhance the flow in the near wellbore region by eroding away near wellbore skin damage. The assembly also allows an operator to accurately position an assembly in a wellbore to ensure that the producing zones of interest are stimulated.

The present invention is an improvement to the previously disclosed assembly for selectively stimulating a wellbore without the use of openhole inflatable packers. Specifically, the system and method is disclosed for cementing the assembly at a desired location within the wellbore. The use of an acid soluble cement pumped down the string of the assembly allows the assembly to be cemented in place within a wellbore. The use of a wipe plug and at least one wiper ball removes any residual cement from the inside of the string. The acid soluble cement also provides that the use of an acid within the string prevents the curing of any residual cement within the string.

SUMMARY OF THE INVENTION

One embodiment of the present invention is directed to a system for selectively stimulating a plurality of producing zones in an oil and gas well comprising a string cemented into a wellbore, a plurality of modules spaced in the string at predetermined locations, wherein each module comprises a housing having a central passageway therethrough, a plurality of passageways extending radially through the housing, and a shifting sleeve slidably mounted within the housing wherein the shifting sleeve is moveable from a closed position over the radial passageways to an open position whereby the radial passageways are in communication with the central passageway of the housing and wherein the shifting sleeve includes a ball seat for receiving an actuating ball for shifting the shifting sleeve from the closed position to the open position. The lowermost module in the assembly is adapted to receive an actuating ball and each successive module in the assembly is adapted to receive a larger actuating ball than the module immediately below it. The size of the ball seat will differ from module to module with the lowermost module having the smallest ball seat and each successive module in the assembly will have a larger ball seat than the module immediately below it. Each of the radial passageways may include a jet nozzle.

Cement may be pumped down the string to cement the string within the wellbore at the desired location. A wiper plug may be pumped down the string after the cement to wipe residual cement from the string. The wiper plug may also help to separate the cement from the displacement fluid pumped down the string after the cement. The wiper plug may be adapted to pass through varying sizes of ball seats found in the modules of the string.

The cement used may be an acid soluble cement and the fluid pumped after the wiper plug may be an acid solution which prevents any residual cement from curing inside of the string. A wiper ball, which may be comprised of rubber, may be pumped down the string after the wiper plug. The wiper ball may be comprised of a natural or synthetic rubber as would be appreciated by one of ordinary skill in the art having the benefit of this disclosure. The wiper ball may also help remove any residual cement from the inside of the string. The wiper ball may be pumped within a spacer fluid to prevent the acid solution from damaging the wiper ball. The acid solution may be pumped down the string to fill the string above the uppermost module to prevent the curing of any residual cement inside of the string while the cement ori the exterior of the string is allowed to cure and set the string within the wellbore. The acid solution may be acetic acid or other acid solutions as would be appreciated by one of ordinary skill in the art having the benefit of this disclosure.

In another embodiment, the housing may include an interchangeable nozzle body wherein the passageways extend radially through the nozzle body. The housing may further comprise a top sub connected to the upper end of the nozzle body and a bottom sub connected to the lower end of the nozzle body.

Each module may further comprise one or more radially extending flow ports in the shifting sleeve beneath the ball seat which communicates with one or more flow ports in the housing when the shifting sleeve is in the open position.

Another embodiment of the present invention is directed to a system for selectively stimulating a plurality of producing zones in an oil and gas well comprising a plurality of modules connected in a string that is cemented within a wellbore. Each module comprises a housing having a central passageway therethrough, one or more passageways extending radially through the housing, and a shiftable sleeve mounted in the central passageway of the module, wherein the shiftable sleeve is moveable from a closed position over the radial passageways to an open position whereby the radial passageways are in communication with the central passageway of the housing, and wherein the shiftable sleeve is adapted to receive an actuating means for shifting the shiftable sleeve from the closed position to the open position. The actuating means may include balls, darts, bars, plugs or similar devices.

One embodiment of the present invention is a method for selectively stimulating a plurality of producing zones in an oil and gas well. The method includes positioning an assembly in the well, the assembly comprising a plurality of modules connected to a string, wherein each module is positioned adjacent a producing zone to be stimulated and each module includes a housing having a central passageway, one or more passageways extending radially through the housing, and a shiftable sleeve slidably mounted within the housing, wherein the shiftable sleeve is adapted to receive an actuating ball for shifting the shiftable sleeve from a closed position over the radial passageways to an open position whereby the radial passageways are in communication with the central passageway of the housing.

The method further includes pumping cement down the string until the cement exits the end of the string and fills an annulus between the string and the wellbore and also pumping a wiper plug down the string. The method also includes pumping an acid solution down the string and allowing the cement in the annulus to cure. Once the cement in the annulus or exterior of the string has cured, the method includes selectively breaking down the cured cement and stimulating each of the producing zones in succession from the lowermost zone to the uppermost zone from the module adjacent each zone by successively moving the shiftable sleeve to the open position in each of the modules beginning with the lowermost module and finishing with the uppermost module by using a progressively larger actuating ball for each of the successive modules.

The method may further include pumping at least one wiper ball down the string. The wiper ball may be a natural rubber wiper ball and may be pumped down the string within a spacer fluid.

BRIEF DESCRIPTION OF THE DRAWINGS

FIG. 1 illustrates a partial cutaway of an assembly for selectively stimulating a plurality of producing zones in an openhole wellbore.

FIG. 2 shows a partial cutaway of one embodiment of a module used in the assembly shown in FIG. 1.

Figure 3:
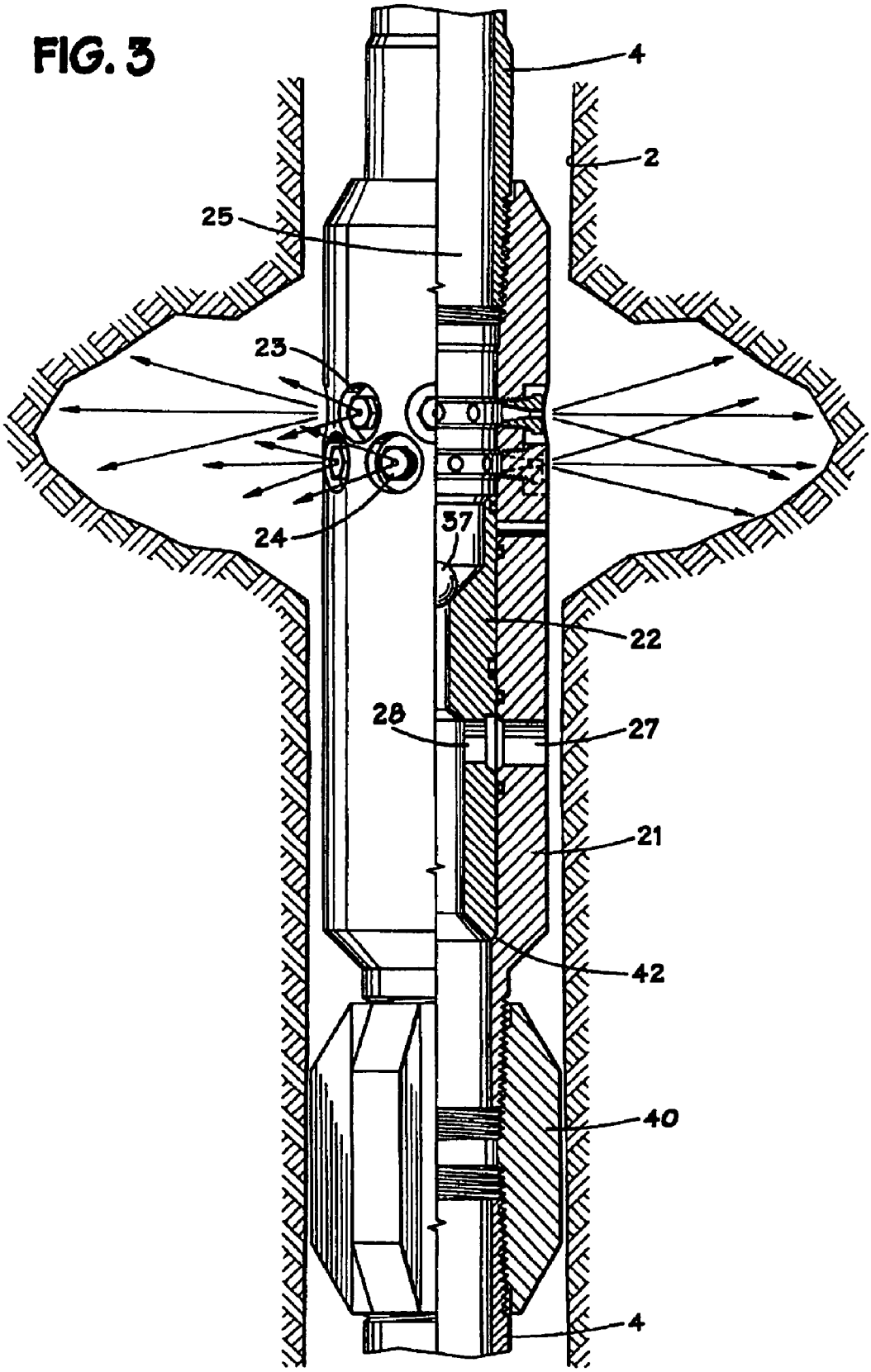
FIG. 3 illustrates the module of FIG. 2 with the shifting sleeve in the open position.

While the invention is susceptible to various modifications and alternative forms, specific embodiments have been shown by way of example in the drawings and will be described in detail herein. However, it should be understood that the invention is not intended to be limited to the particular forms disclosed. Rather, the intention is to cover all modifications, equivalents and alternatives falling within the spirit and scope of the invention as defined by the appended claims.

DESCRIPTION OF ILLUSTRATIVE EMBODIMENTS

Illustrative embodiments of the invention are described below as they might be employed in a method and system for selectively simulating multiple production zones or intervals within a subterranean oil or gas well, the system being cemented within the well. Persons of ordinary skill in the art, having the benefit of the present disclosure, will recognize that the teachings of the present disclosure will find application in any number of alternative embodiments employing the general teachings of the illustrative embodiments. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Further aspects and advantages of the various embodiments of the invention will become apparent from consideration of the following description and drawings.

Referring to FIGS. 1-3, a preferred embodiment of an assembly for selectively stimulating producing zones in a subterranean wellbore will now be described. The assembly 1 includes a plurality of modules which are attached to a tailpipe 4 (shown in cutaway to reflect the longitudinal distance between the modules). The assembly in FIG. 1 includes modules 5, 10, 15 and 20. Tailpipe 4 is suspended from service packer 3 which is set inside casing 6, above the openhole wellbore 2. The service packer may be, for example, a compression packer, such as an SD-1 or MR1220 packer available from BJ Services Company. A workstring of tubing, drillpipe or the like extends from packer 3 to the surface. The tailpipe string, being suspended from packer 3, extends into the openhole beneath the casing shoe. In a preferred embodiment, modules 5, 10, 15 and 20 are spaced in the tailpipe string at predetermined locations so that an individual module is adjacent a producing zone desired to be stimulated. The tailpipe string may be comprised of tubing, drillpipe or the like and the length of tailpipe between adjacent modules will depend on the distance between the producing zones or targets of interest. Alternatively, it will be understood that the packer could be reset at different locations in the casing to locate one or more modules of the assembly adjacent one or more producing zones or targets of interest. In other words, the entire assembly can be repositioned within the wellbore to more accurately position some of the modules without tripping the assembly out of the wellbore.

As shown in FIG. 2, each module comprises a generally tubular-shaped housing 21 which includes a threaded upper and lower end for connecting the module to the tailpipe string. Central passageway 25 extends longitudinally through housing 21. Each module includes shifting sleeve 22 which is adapted for longitudinal movement along the inner wall of housing 21. Shifting sleeve 22 includes one or more radially extending ports 28 which are arranged about the circumference of the sleeve. Housing 21 also includes one or more radially extending ports 27 circumferentially spaced about the housing. The number of ports 28 in shifting sleeve 22 will correspond to the number of flow ports 27 in housing 21. Shifting sleeve 22 includes a landing seat or ball seat 35. The size of ball seat 35 will differ from module to module in the assembly, with the lowermost module 20 having the smallest ball seat and the uppermost module 5 having the largest ball seat.

Housing 21 may include a plurality of nozzle holes 23 which extend radially through the wall of housing 21 for receiving interchangeable jet nozzles 24. Jet nozzles 24 may be held in nozzle holes 23 by any suitable means such as mating threads, snap rings, welding or the like. Jet nozzles may come in a wide variety of orifice sizes. The size of the nozzle orifice may be predetermined to achieve the desired fluid hydraulics for a particular acid job. Some of the nozzles may be selectively blanked off to achieve the optimum flow rates and pressure drops across the remaining nozzles. In general, the number and size of the working jet nozzles will reflect the desired kinetic energy to be used in treating a given producing zone.

Shifting sleeve 22 is initially attached to housing 21 in the closed position by one or more shear screws 30 so that the shifting sleeve straddles jet holes 23, jet nozzles 24 and fluid flow ports 27. Seals 32 seal the annular space between shifting sleeve 22 and housing 21. Elastomeric seals 32 may be o-ring seals, molded seals or other commonly used oilfield seals. The remaining components of the module may be manufactured from common oilfield materials, including various steel alloys.

As shown in FIG. 3, centralizing coupling 40 may be attached to the lowermost end of housing 21. Centralizing coupling 40 not only connects the module to lower tailpipe 4 but also centralizes the module and assembly in the wellbore. Centralizing coupling 40 includes a plurality of centralizing ribs, with adjacent fluid flow passageways therebetween.

As shown in FIG. 1, an assembly for selectively stimulating a plurality of intervals or targets in a wellbore includes a plurality of modules assembled in a tailpipe string. By varying the length of tailpipe between modules, an operator can space the individual modules so that a module is adjacent each desired producing interval or target to be stimulated. The selectivity is provided by varying the size of the landing seat 35 on shifting sleeve 22. The lowermost module 20 will have the smallest ball seat 35, i.e., the smallest internal diameter of any of the modules, for catching the smallest ball. The next to last module in the assembly will have a slightly larger ball seat 35 and so on until the uppermost module, which will have the largest ball seat, i.e., the largest internal diameter of any of the modules. Thus, the actuating balls for the assembly will increase in diameter as one moves from the lowermost module to the uppermost module.

In operation, the assembly of FIG. 1 is run into the wellbore suspended from packer 3. The packer is set in the production casing near the casing shoe at a predetermined location. Tailpipe 4 and modules 5, 10, 15 and 20 extend beneath the casing shoe into the open hole. The modules are spaced apart in the tailpipe string so that each particular module will be adjacent to a producing zone that the operator desires to stimulate. The stimulation treatment begins with the lowermost zone and works its way up the wellbore. An appropriate sized ball is dropped or pumped down the workstring and into the assembly until it lands on seat 35 of shifting sleeve 22 in the lowermost module 20. Pressure is increased inside the work string and assembly until the force acting across the actuating ball and ball seat exceeds the shear value for shear screw 30. Once shear screw 30 is sheared, shifting sleeve 22 is shifted downward to the treating position against shoulder 42 of housing 21. As shown in FIG. 3, when the shifting sleeve is in the open or treating position, jet nozzles 24 are in communication with central passageway 25. Once landed, ball 37 prevents acid from passing out the bottom of the assembly. Acid is then pumped at a desired rate through jet nozzles 24 to acidize and erode the wellbore adjacent the jet nozzles. The kinetic energy created by pumping the acid through the jet nozzles mechanically erodes away the wellbore formation adjacent the nozzles as illustrated in FIG. 3.

Upon completion of the acid stimulation treatment of the lowermost zone or target, a slightly larger ball is dropped or pumped down the workstring into the assembly where it passes through the upper modules and lands on the ball seat of module 15. Pressure is again increased inside the workstring to shift the shifting sleeve from the closed position to the open position so that the jet nozzles of module 15 are exposed. Acid is then pumped through the jet nozzle of module 15 to acidize and erode the wellbore adjacent the module. The ball in module 15 prevents acid from flowing down to module 20.

The remainder of the zones of interest or targets are selectively acidized or treated by dropping or pumping successively larger balls into the assembly and repeating the above-described sequence. Upon completion of the stimulation treatment of all zones, the packer can be released from the production casing and the assembly can be pulled out of the well.

The assembly allows an operator to selectively stimulate a number of producing zones in a wellbore in a single trip. By dropping successively larger actuating balls, an operator can shift a sleeve in successive modules and then squeeze and jet a desired volume of hydrochloric acid or other type of acid into the producing zones of the interest. By diverting the acid through the nozzles in the modules, the acid will impact the wellbore at high velocity under squeezed pressures. The kinetic energy of the acid will erode away the wellbore and thereby create a cavern in addition to penetrating the formation rock with the acid. The acidizing and wellbore erosion will enhance the ability of oil or other hydrocarbons to flow into the wellbore at these locations. The wellbore is thus treated both mechanically and chemically by dissolving materials that are plugging the pores of the formation rock, such as fines, paraffins, or clays or other materials that have reduced the porosity and/or permeability of the formation. By jetting a large govern at the face of the wellbore, the resistance to the flow of oil or gas into the wellbore is reduced. Although not limited to such application, the present invention is well suited for stimulating a calcareous formation with, for example, hydrochloric acid.

Figure 4:
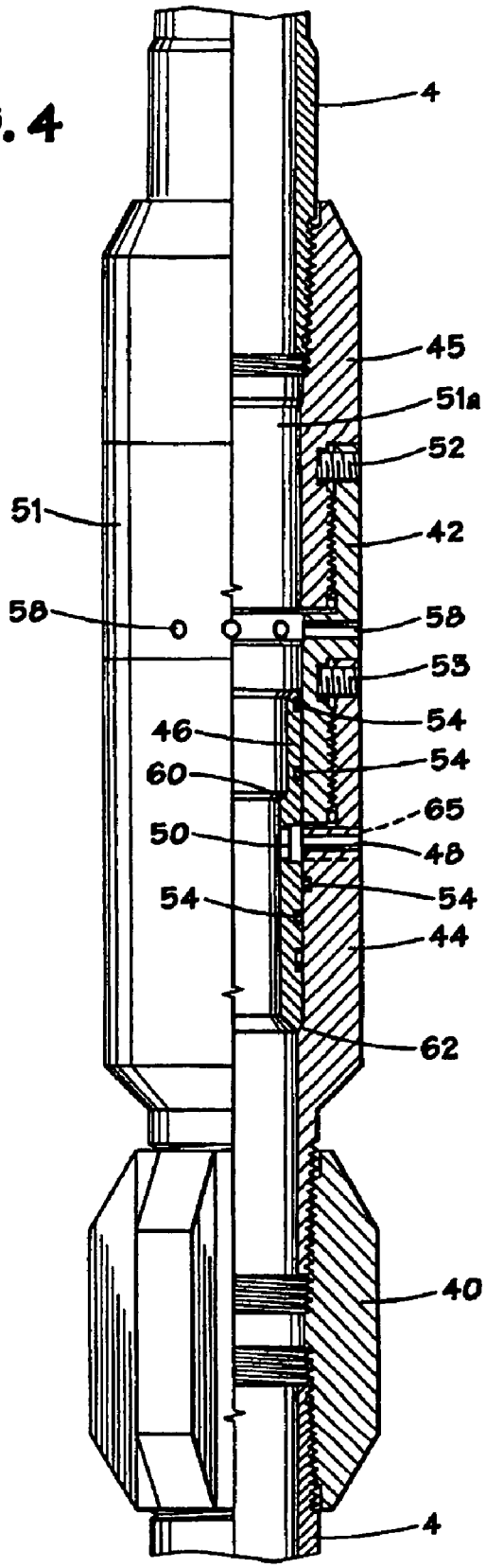
FIG. 4 shows a partial cutaway of an alternative embodiment of a module for use in an assembly for selectively stimulating a plurality of producing zones in a wellbore.

An alternative embodiment of a module for use in an assembly of the present invention is shown in FIG. 4. The module has a generally tubular shaped housing 51 comprising top sub 45, nozzle body 42, and bottom sub 44. Central passageway 51*a* extends longitudinally through the module. The upper portion of top sub 45 includes internal threads for connecting the module to upper tailpipe 4. Top sub 45 includes external threads on its lower end for connecting top sub 45 to nozzle body 42. Nozzle body 42 includes internal threads for mating with the external threads of top sub 45. Nozzle body 42 also includes external threads on its lowermost end for mating with internal threads on the upper end of bottom sub 44. Bottom sub 44 includes threads on its lowermost end for mating with internal threads on centralizing coupling 40. Centralizing coupling 40 is threadedly attached to the lower tailpipe 4.

Nozzle body 42 may be further secured to top sub 45 by one or more set screws 52. Similarly, nozzle body 42 may be further secured to bottom sub 44 by one or more set screws 53. Nozzle body 42 has a plurality of radially extending nozzle ports 58 drilled therethrough. The nozzle ports 58 extend about the circumference of nozzle body 42. The number and size of nozzle ports 58 may vary from module to module depending on the fluid flow characteristics required for the stimulation treatment at each desired producing zone. By way of example, nozzle body 42 may include eight nozzle ports ranging in diameter from 1/16 to 3/16 of an inch spaced approximately 45 degrees apart about the circumference of the nozzle body.

Shifting sleeve 46 is adapted for longitudinal movement along the inner wall of housing 51. Sleeve 46 includes one or more radially extending flow ports 50. The annular space between shifting sleeve 46 and the inner walls of top sub 45, nozzle body 42, and bottom sub 44 is sealed by a plurality of seals 54. Sleeve 46 is shifted from a closed position straddling nozzle ports 58 to the stimulating position shown in FIG. 4 by landing an appropriately sized shifting ball (not shown) on ball seat 60. Sleeve 46 is initially held in the closed position by one or more shear screws 48. After a shifting ball lands on seat 60 (not shown), the tubular pressure is increased until shear screws 48 shear allowing shifting sleeve 46 to be longitudinally moved downward to the stimulating position. Shoulder 62 may be provided to stop the downward movement of sleeve 46. In the stimulating position, flow ports 50 are aligned with a corresponding number of flow ports 65 in bottom sub 44, as shown by the dotted line. Flow ports 65 extend radially through the bottom sub and are spaced, for example, 45 degrees apart from shear screws 48 along the same plane.

An operator can change the size and number of nozzle ports in a module by using interchangeable nozzle bodies 42. The interchangeable nozzle bodies provide an operator an alternative to the use of interchangeable jet nozzles as described in the embodiment of FIG. 2. Nozzle body 42 may be made of a variety of steel alloys commonly used in the oil industry or may be made of high chromium materials or heat treated metals to increase the erosion resistance of nozzle ports 58. The remaining portions of the module, including top sub 45, bottom sub 44 and shifting sleeve 46, can be made of a variety of steel alloys commonly used in the oil field.

Although different embodiments of a module are illustrated in FIGS. 2 and 4, the method of selectively actuating the different modules of an assembly can be more readily understood by comparing the respective ball seats of the modules in these figures. As can be seen, the internal diameter of ball seat 60 in the module of FIG. 4 is substantially larger than the internal diameter of ball seat 35 in the module of FIG. 2. Thus, the actuating ball for seat 35 will easily pass through ball seat 60 and continue through the assembly until it lands on seat 35 of the lower module. Therefore, an operator can selectively actuate the modules in the assembly from the bottom up by dropping or displacing progressively larger actuating balls into the assembly, thereby allowing the operator to selectively stimulate a plurality of producing zones in a single trip.

Although the embodiments described above are actuated by using successively larger balls, it should be readily understood that the modules can be actuated by other means. For example, the shifting sleeves of the modules could be easily adapted to be actuated by dropping or pumping down the assembly appropriately sized darts, bars, plugs, or the like. Alternatively, each shiftable sleeve may include a selective profile, such as an Otis "X" or "R" style profile, and the actruating means for a particular sleeve would include a locking mechanism with a mating profile. In such an embodiment, the actuating means would pass through all modules except the module that had a shifting sleeve with a mating profile.

Figure 5:
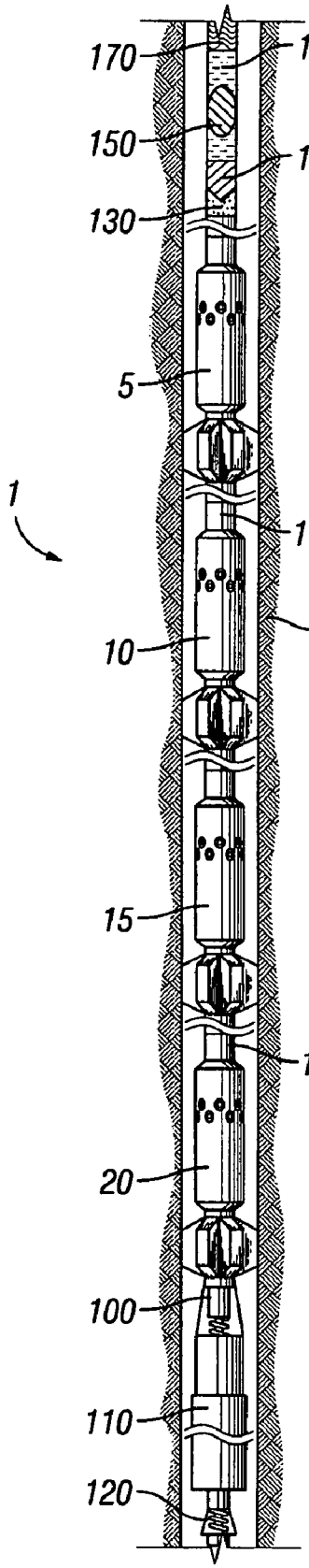
FIG. 5 illustrates a partial cutaway of a system that may be cemented in a wellbore and used for selectively stimulating a plurality of producing zones in an openhole wellbore.

FIG. 5 shows the process of cementing an assembly 1 into the open wellbore 2. Cement 130 is pumped down a string 104 through the plurality of modules 5, 10, 15, and 20 attached to the string 104. A float collar 100 is connected to the centralizing coupling connected to the lowermost module 20. Alternatively, the float collar 100 may be connected directly to the lowermost module 20 or a portion of the string 104 located below the lowermost module 20. The cement 130 is pumped through a shoe joint 110 and float shoe 120 connected to the float collar 100. The cement 130 exits the float shoe 120 and fills the annulus between the string 104 and the open wellbore 2 to cement the string 104 within the open wellbore 2.

A wiper plug 140 is pumped down the string 104 above the trailing end of the cement 130 being pumped down the string 104. The wiper plug 140 wipes the string 104 removing cement 130 from the interior of the string 104 and from the interior of the modules 5, 10, 15, and 20. The wiper plug 140 is pumped to the end of the string 104 removing the cement 130 within the string 104 until it reaches the float shoe 120. Alternatively, the wiper plug 140 may be landed in the float collar 100. At least one wiper ball 150 may also be pumped down the string 104 to remove any residual cement 130 remaining in the string 104 or in any of the modules 5, 10, 15, and 20. Multiple wiper balls 150 may be pumped down the string 104 in an effort to wipe the string 104 and modules 5, 10, 15, and 20 of any residual cement 130. The wiper ball 150 may be comprised of natural rubber or other materials that allow the wiper ball to wipe the string 104. Further, multiple wiper balls 150 having differing outer diameters may be used to ensure the removal of residual cement 130 as would be appreciated by one of ordinary skill in the art having the benefit of this disclosure. The wiper ball 150 used to wipe the string 104 and the modules 5, 10, 15, and 20 may be, for example, a drill-pipe wiper ball comprised of natural caoutchouc rubber commercially offered by Halliburton.

An acid solution 170, such as acetic acid, may then be pumped down the string 104 to displace the cement 130 and the wiper plug 140 and wiper ball(s) 150. The acid solution 170 may prevent any residual cement 130 from setting or curing within the string 104 and the modules 5, 10, 15, and 20. Further, the acid solution 170 may break up or fracture the cement 130 on the exterior of the string 104 at the module locations when the stimulation process, as discussed above, begins. The wiper ball 150 may be pumped down the string 104 in a spacer fluid 160 between the cement 130 and the acid solution 170 to help protect the wiper ball 150 from being damaged by the acid solution 170. The acid solution 170 may be pumped down the string 104 until the central passageway of each module contains the acid solution 170. After the acid solution 170 has been pumped into and retained in the string 104, the operator will allow the cement 130 on the exterior of the string 104 to cure and cement the string 104 within the open wellbore 2. The presence of the acid solution 170 within the string 104 during the curing process may ensure that the slidable sleeves within the modules function properly when actuated.

Figure 6:
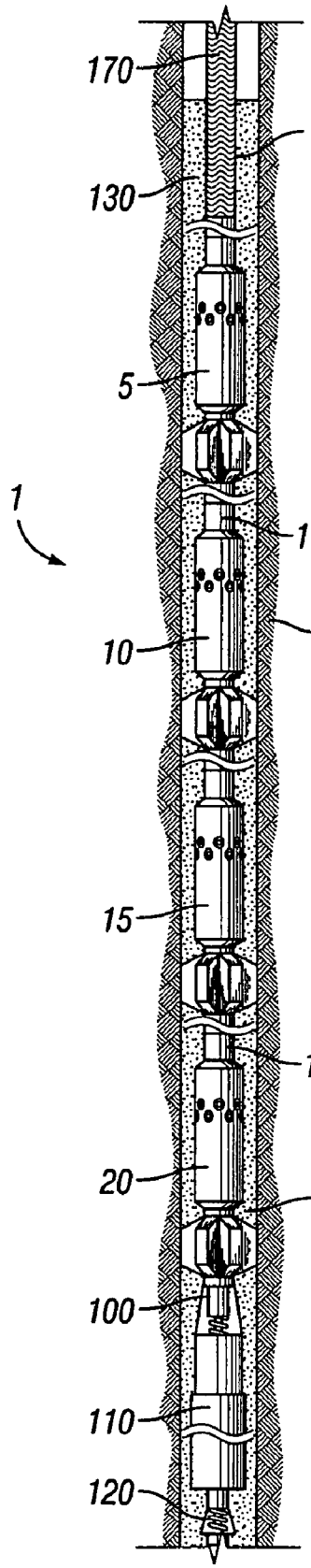
FIG. 6 illustrates a partial cutaway system for selectively stimulating a plurality of producing zones, the system being cemented within the wellbore.

FIG. 6 illustrates the assembly 1 cemented in the open wellbore 2. At this point, fluid may be pumped within the string 104 until the hydraulic pressure moves the sliding sleeve of the lowermost module 5 to its open position. After the sleeve is in its open position, the acid solution 170 will exit through the radial passageways and begin to break down and remove the cement 130 that has formed adjacent to the module. The fluid will then fracture the formation once it has removed the cement at the zone of interest. The next module will be actuated as discussed above and the process will be repeated until each of the zones of interest has been stimulated.

Although various embodiments have been shown and described, the invention is not so limited and will be understood to include all such modifications and variations as would be apparent to one skilled in the art. Other numerous changes in the details of construction and arrangement of parts will be readily apparent to those skilled in the art and which are encompassed within the spirit of the invention and the scope of the appended claims.

What is claimed is:

1. A method for selectively stimulating a plurality of producing zones in an oil and gas well comprising:

positioning an assembly in the well, the assembly comprising a plurality of modules connected to a string, wherein each module is positioned adjacent a zone to be stimulated and each module includes a housing having a central passageway, one or more passageways extending radially through the housing, and a shiftable sleeve slidably mounted within the housing, wherein the shiftable sleeve is adapted to receive an actuating ball for shifting the shiftable sleeve from a closed position over the radial passageways to an open position whereby the radial passageways are in communication with the central passageway of the housing;

pumping cement down the string and into an annulus between the string and the wellbore;

pumping a wiper plug down the string;

pumping an acid solution down the string, wherein the acid solution is pumped down the string prior to the curing of the cement;

allowing the cement in the annulus to cure;

selectively breaking down the cured cement and stimulating each of the producing zones in succession from the lowermost zone to the uppermost zone from the module adjacent each zone by successively moving the shiftable sleeve to the open position in each of the modules beginning with the lowermost module and finishing with the uppermost module by using a progressively larger actuating ball for each of the successive modules.

2. The method of claim 1 further comprising pumping at least one wiper ball down the string.

3. The method of claim 2 wherein the at least one wiper ball is pumped down the string within a spacer fluid.

4. The method of claim 2 wherein the at least one wiper ball is a natural rubber wiper ball.

5. The method of claim 1 wherein the acid solution pumped down the string is acetic acid.

6. The method of claim 1 wherein the wiper plug is a flexible wiper plug.

* * * * *